US006058744A

United States Patent [19]

Ling

[11] Patent Number: 6,058,744

[45] Date of Patent: May 9, 2000

[54] COMBINATION LOCK HAVING PIVOTAL LATCH INSERTABLE AND LOCKABLE IN AN OBJECT APERTURE

[76] Inventor: Chong-Kuan Ling, 2F, No. 80, An-Ho Road, Sec. 2, Taipei, Taiwan

[21] Appl. No.: 09/200,529

[22] Filed: Nov. 26, 1998

[51] Int. Cl.[7] ..... E05B 73/00

[52] U.S. Cl. ..... 70/28; 70/58; 70/312

[58] Field of Search ..... 70/27–29, 58, 70/312, 425, 426

[56] References Cited

U.S. PATENT DOCUMENTS

| | | | |
|---|---|---|---|
| 89,826 | 5/1869 | Arnold | 70/28 |
| 442,778 | 12/1890 | Metzger | 70/426 |
| 942,537 | 12/1909 | Batdorf | 70/426 |
| 4,354,366 | 10/1982 | Bako | 70/312 |
| 4,355,524 | 10/1982 | Bako | 70/312 |
| 4,860,561 | 8/1989 | Hwang | 70/28 |
| 5,193,367 | 3/1993 | Ling | 70/312 X |
| 5,685,179 | 11/1997 | Yang | 70/28 |
| 5,701,769 | 12/1997 | Hall | 70/58 X |
| 5,765,409 | 6/1998 | Yang | 70/28 |
| 5,782,113 | 7/1998 | Chen | 70/312 X |
| 5,791,171 | 8/1998 | Kelley | 70/57 X |
| 5,901,587 | 5/1999 | Chen | 70/312 X |

FOREIGN PATENT DOCUMENTS

| | | | |
|---|---|---|---|
| 335741 | 4/1921 | Germany | 70/202 |
| 349946 | 3/1922 | Germany | 70/29 |
| 3084177 | 4/1991 | Japan | 70/312 |
| 1146723 | 3/1969 | United Kingdom | 70/30 |

*Primary Examiner*—Lloyd A. Gall

[57] ABSTRACT

A combination lock includes: a casing, a fixed latch member and a pivotal latch member formed in a front portion of the casing to be inserted into an aperture of a computer or the like, a control bolt reciprocatively held in the casing and having a plurality of dials and sleeves rotatably mounted on the bolt for allowing or retarding the pivotal movement of the pivotal latch member for unlocking or locking the two latch members within the aperture of the computer or the like, and a push button slidably held on the casing for depressing and retracting the control bolt backwardly for biasing the pivotal latch member for a withdrawal of the two latch members from the aperture of the computer or the like for a convenient unlocking of the combination lock.

6 Claims, 5 Drawing Sheets

COMBINATION LOCK HAVING PIVOTAL LATCH INSERTABLE AND LOCKABLE IN AN OBJECT APERTURE

BACKGROUND OF THE INVENTION

U.S. Pat. No. 5,791,171 to Donald W. Kelley disclosed a scissor lock with removable cable adapter including a locking mechanism having a shaft (50) rotated between an unlock position and a lock position, a cam (22) connected to the shaft (50) for rotation therewith and a scissor pivot assembly (15) connected to the cam (22) for translating the rotary motion of the cam into linear motion of a pair of scissor arms (55*a*, 55*b*) in the scissor pivot assembly (15). The pair of scissor arms (55*a*, 55*b*) will be in an overlapping closed position when the locking mechanism is in the unlock position allowing the scissor arms to be inserted into the object aperture, and the pair of scissor arms will be spread apart when locked preventing the withdrawal of the scissor arms from the aperture.

However, such a conventional scissor lock has the following drawbacks:

1. The security device must be unlocked or locked by a key, which however may be easily forgotten to carry or even lost, causing inconvenience of uses.

2. Whenever unlocking or locking the security device, a key should be inserted into the lock (21) for cross pivotal movement of the two scissor arms (55*a*, 55*b*), requiring two hands of the user for the locking or unlocking operation, such as for holding the lock housing by the user's one hand and for rotating the key and locking mechanism by the user's another hand to thereby cause operation inconvenience.

3. The front opening formed in the front portion of the device (within seal "29") may be easily intruded (FIG. 2 of the prior art) to rotate the cam (22) for unlocking the two scissor arms (55*a*, 55*b*), thereby deteriorating the security effect.

The present inventor has found the drawbacks of the conventional computer lock and invented the combination lock having pivotal latch insertable and lockable in an aperture of a computer or the like.

SUMMARY OF THE INVENTION

The object of the present invention is to provide a combination lock including: a casing, a fixed latch member and a pivotal latch member formed in a front portion of the casing to be inserted into an aperture of a computer or the like, a control bolt reciprocatively held in the casing and having a plurality of dials and sleeves rotatably mounted on the bolt for allowing or retarding the pivotal movement of the pivotal latch member for unlocking or locking the two latch members within the aperture of the computer or the like, and a push button slidably held on the casing for depressing and retracting the control bolt backwardly for biasing the pivotal latch member for a withdrawal of the two latch members from the aperture of the computer or the like for a convenient unlocking of the combination lock.

DETAILED DESCRIPTION

Figure 1:
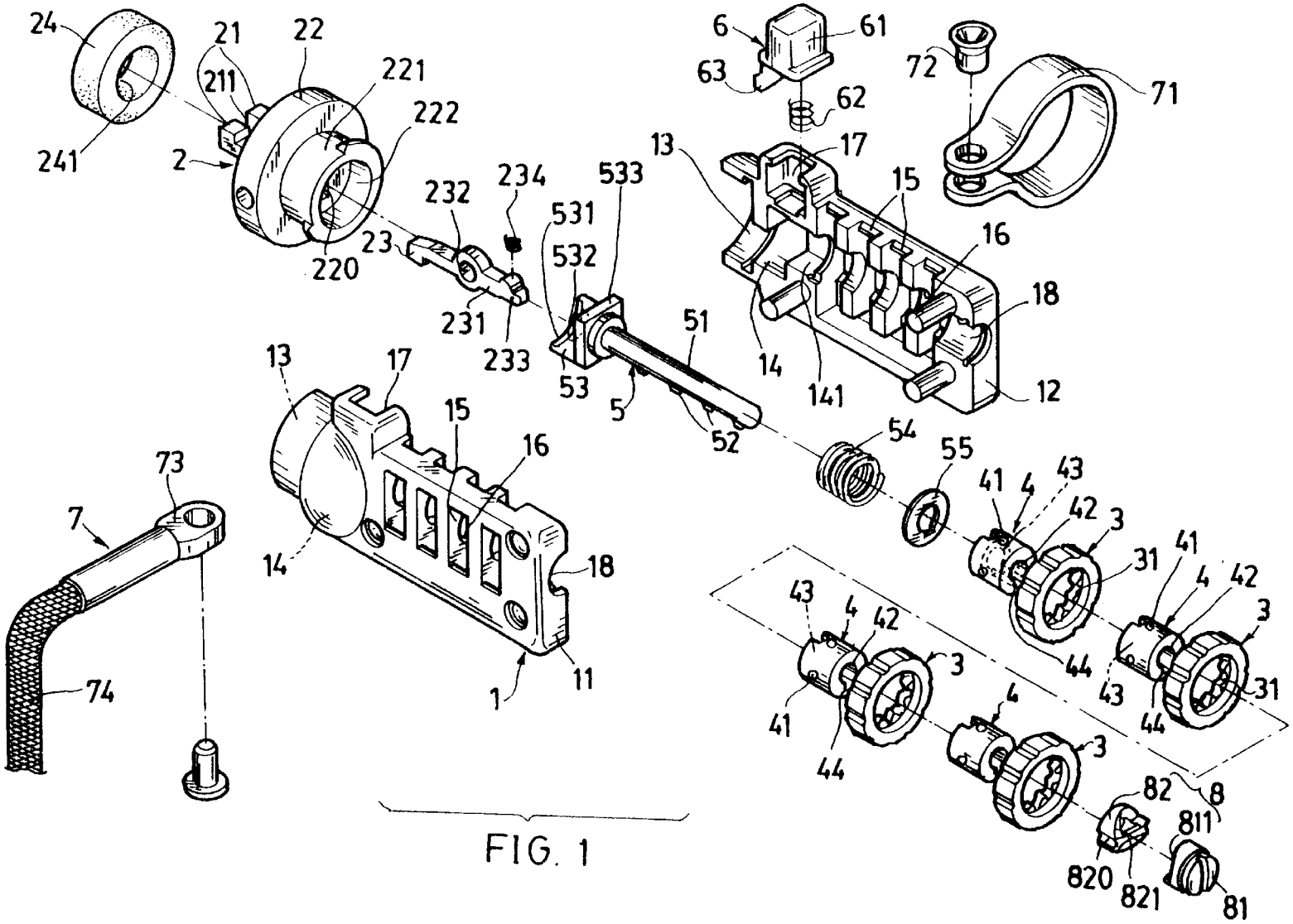
FIG. 1 is an exploded view showing the elements of the present invention.

As shown in FIGS. 1~5, a combination lock, adapted for use in computers, notebook personal computer, computer-related equipments or devices and portable electronic instruments P provided with an aperture A therein, comprises: a casing 1, a pivotal latch means 2 formed in a front portion of the casing 1 to be lockable in the aperture A of the computers or the like, a plurality of dials 3 and sleeves 4 rotatably mounted in the casing 1, a control means 5 formed in the casing 1 for controlling the locking and unlocking of the pivotal latch means 2, a push button means 6 held in the casing for actuating the control means 5 for unlocking the pivotal latch means 2 from the computers or the like P, a fastening device 7 secured on the casing I for fastening the combination lock to a fixture F such as a building fixture or a strong stable furniture, and a combination-changing means 8 formed in the casing 1 for resetting a new combination for locking the lock.

The casing 1 is formed by combining two half shells 11, 12 and includes: a front socket 13 for connecting a latch holder 22 of the pivotal latch means 2, an operation chamber 14 formed in a middle portion of the casing 1 having a square (or rectangular) sectioned chamber 141 communicated with the operation chamber 14 and protruded rearwardly from the operation chamber 14, a plurality of dial slots 15 cut out in the casing for protruding the dials 3 outwardly through the dial slots 15, a plurality of sleeve recesses 16 formed in the casing 1 for holding the sleeves 4 in the sleeve recesses 16, a button hole 17 formed through the casing 1 for protruding a push button 61 of the push button means 6 outwardly through the button hole 17, and a cylindrical hole 18 formed in a rear portion of the casing 1 for providing the combination-changing means 8 in the cylindrical hole 18.

Even though the latch holder 22 of the pivotal latch means 2 is coupled and secured in the front portion of the casing 1 as shown in the drawings, the latch holder 22 may also be integrally formed with the front portion of the casing 1, not limited in this invention.

Figure 4:
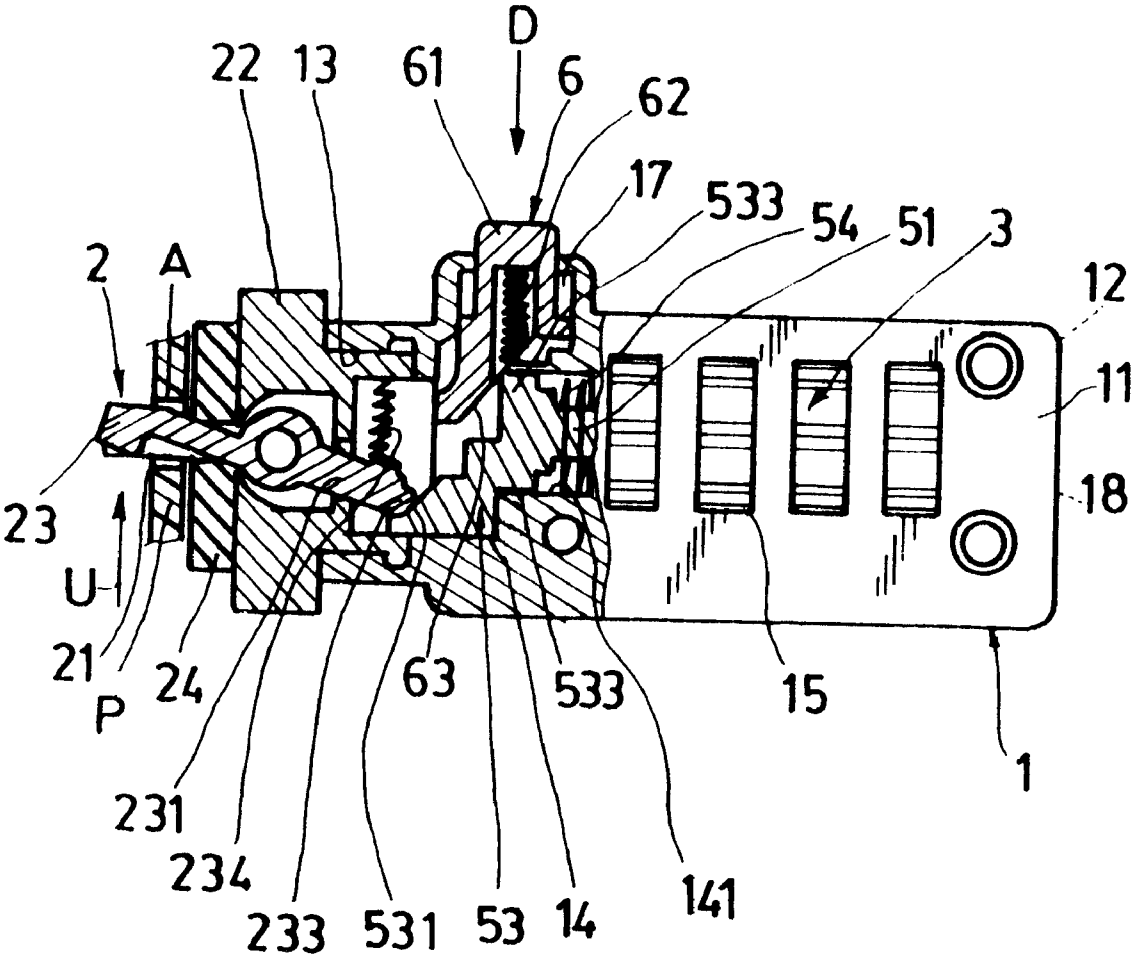
FIG. 4 is an illustration showing an unlocking of the present invention when depressing the push button.

The pivotal latch means 2 includes: a fixed latch member 21 protruding forwardly from a latch holder 22 secured on a front portion of the casing 1, and a pivotal latch member 23 pivotally mounted in the latch holder 22; with the pivotal latch member 23 having a front hook portion resiliently biased upwardly (as numeral "U" as shown in FIG. 4) to projectively coincide with or to be close combinable with at least a fixed front hook portion of the fixed latch member 21 to obtain a cross sectional area of the fixed latch member 21 and the pivotal latch member 23 to be slightly less than an area of the aperture A in order to be withdrawn through the aperture A of the computer P or the like when unlocking the combination lock of the present invention; and upon a downward biasing of the front hook portion of the pivotal latch member 23 to allow the two front hook portions of the two latch members 21, 23 to be separately extended and locked in the aperture A of the computer, the computer will be locked with the combination lock.

The fixed latch member 21 includes a pair of fixed front hook portions juxtapositionally formed on a front portion of the latch holder 22, defining a central aperture 211 between the two fixed front hook portions allowing a biasing movement of the front hook portion of the pivotal latch member 23 to be spaced within the central aperture 211 when unlocking the combination lock.

The pivotal latch member 23 includes: a latch lever 231 pivotally mounted by a pivot 232 in a biasing chamber 222 formed in a cylindrical portion 221 protruding rearwardly from the latch holder 22, an actuating end portion 233 formed on an inner end of the latch lever 231 opposite to the front hook portion and a tensioning spring 234 retained in the cylindrical portion 221 and the actuating end portion 233 of the latch lever 231 for normally resiliently depressing the actuating end portion 233 downwardly and for biasing the front hook portion of the latch lever 231 upwardly for projectively coinciding and combining the front hook portion of the pivotal latch member 23 with the fixed front hook portions of the fixed latch member 21 for unlocking the pivotal latch means 2 as withdrawn from the aperture A of the computer P or the like.

The pivotal latch means 2 further includes a cushioning pad 24 fixed on a front portion of the latch holder 22 having a central hole 241 formed in the pad 24 to allow the biasing movement of the pivotal latch member 23 through the central hole 241 and through a latch opening 220 formed in the central portion of the latch holder 22.

Figure 3:
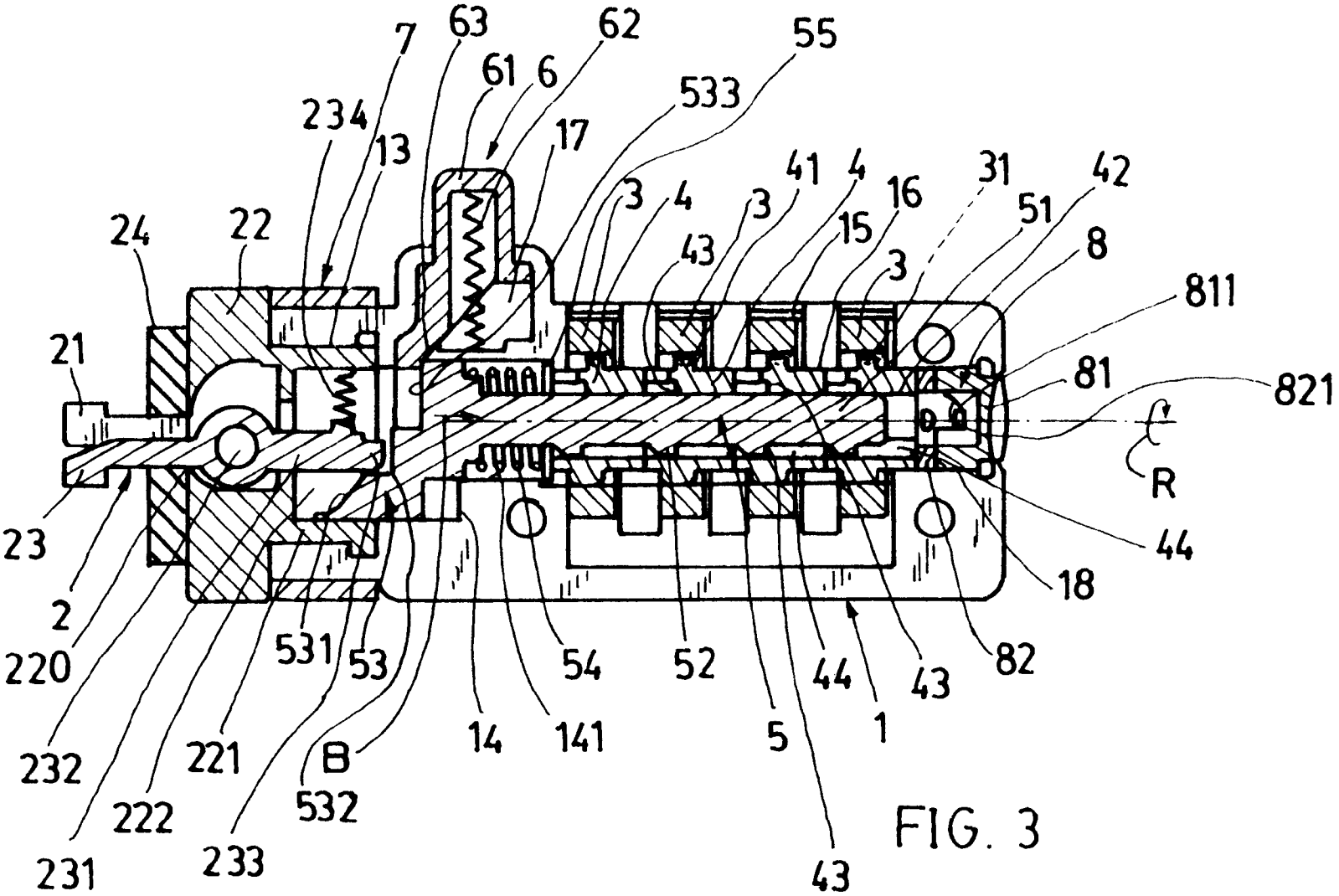
FIG. 3 is a sectional drawing of the present invention at an unlockable state.

Each sleeve 4 includes: a plurality of protrusions 41 circumferentially formed on a cylindrical surface of the sleeve 4 each protrusion 41 engageable with a recess 31 of a plurality of the recesses 3 1 annularly recessed in an inside wall of each dial 3 for coupling each sleeve 4 with each dial 3 for a simultaneous rotation of the dial 3 and the sleeve 4, a central hole 42 formed through the sleeve for rotatably engaging the bolt 51 in the central hole 42 of each sleeve 4, an annular extension 43 annularly formed on an inside wall of the central hole 42 of the sleeve 4 for retarding a projection 52 formed on the bolt 5 thereby retarding a backward retraction of the bolt 51 of the control means 5 when the combination lock is locked, and a slot 44 formed through the annular extension 43 for passing the projection 52 of the bolt 51 through the slot 44 allowing a retraction (B) of the bolt 51 when the combination lock is unlocked (FIGS. 3, 4).

The control means 5 includes: a control bolt 51 reciprocatively held in the casing 1, a plurality of projections 52 equally spaced and formed on the bolt 51, a control head portion 53 formed on a front end portion of the bolt 51 for retarding an unlocking of the pivotal latch member 23 when the combination lock is locked, a restoring spring 54 retained between the control head portion 53 and a washer 55 rested upon a front sleeve of the sleeves 4 rotatably mounted on the bolt 51, with the restoring spring 54 normally urging the pivotal latch member 23 to be locked on the aperture A of the computer P in cooperation with the fixed latch member 21 for locking the combination lock.

The control head portion 53 includes: a wedge portion 531 formed on a front end of the control head portion 53 inclined downwardly forwardly to thrust and lift the actuating end portion 233 of the pivotal latch member 23 upwardly and to bias the front hook portion of the pivotal latch member 23 downwardly to be separately extended from the fixed latch member 21 for locking the combination lock (FIG. 2), a retarding seat portion 532 formed on an inner upper end of the wedge portion 531 for holding the actuating end portion 233 of the pivotal latch member 23 on the seat portion 532 for locking the pivotal latch member 23 for locking the combination lock, and a thrusting disk portion 533 formed on a rear end of the control head portion 53 and urged by the restoring spring 54 to be normally contacted with the push button means 6; whereby upon a downward depression (D) of the push button means 6 (FIG. 4), the thrusting disk portion 533 will be thrusted rearwardly, without retarding the actuating end portion 233 of the pivotal latch member 23, for unlocking the pivotal latch member 23 for unlocking the combination lock (FIG. 4).

The thrusting disk portion 533 of the control head portion 53 of the control means 5 is formed as a square (or a rectangular) shape for its cross section slidably engageable with the square sectioned chamber 141 formed in the casing, thereby preventing a rotation of the bolt 51, and ensuring a linear reciprocative motion of the bolt in the casing.

The push button means 6 includes: a push button 61 slidably held in the button hole 17 formed in the casing 1, a restoring spring 62 retained in the casing and normally urging the push button 61 upwardly ready for a depression when unlocking the lock, and a sloping surface 63 formed on a lower portion of the push button 61 and inclined downwardly forwardly for depressing and driving the thrusting disk portion 533 of the control head portion 53 rearwardly (the projection 52 on bolt 51 slidably engageable with the slot 44 of the sleeve 4 allowing a retraction B of the bolt 51) in order to allow the tensioning spring 234 to urge the actuating end portion 233 of the pivotal latch member 23 downwardly to bias the front hook portion of the pivotal latch member 23 upwardly to unlock the latch means 2 from the aperture A of the computer P when unlocked (FIGS. 3, 4).

Figure 5:
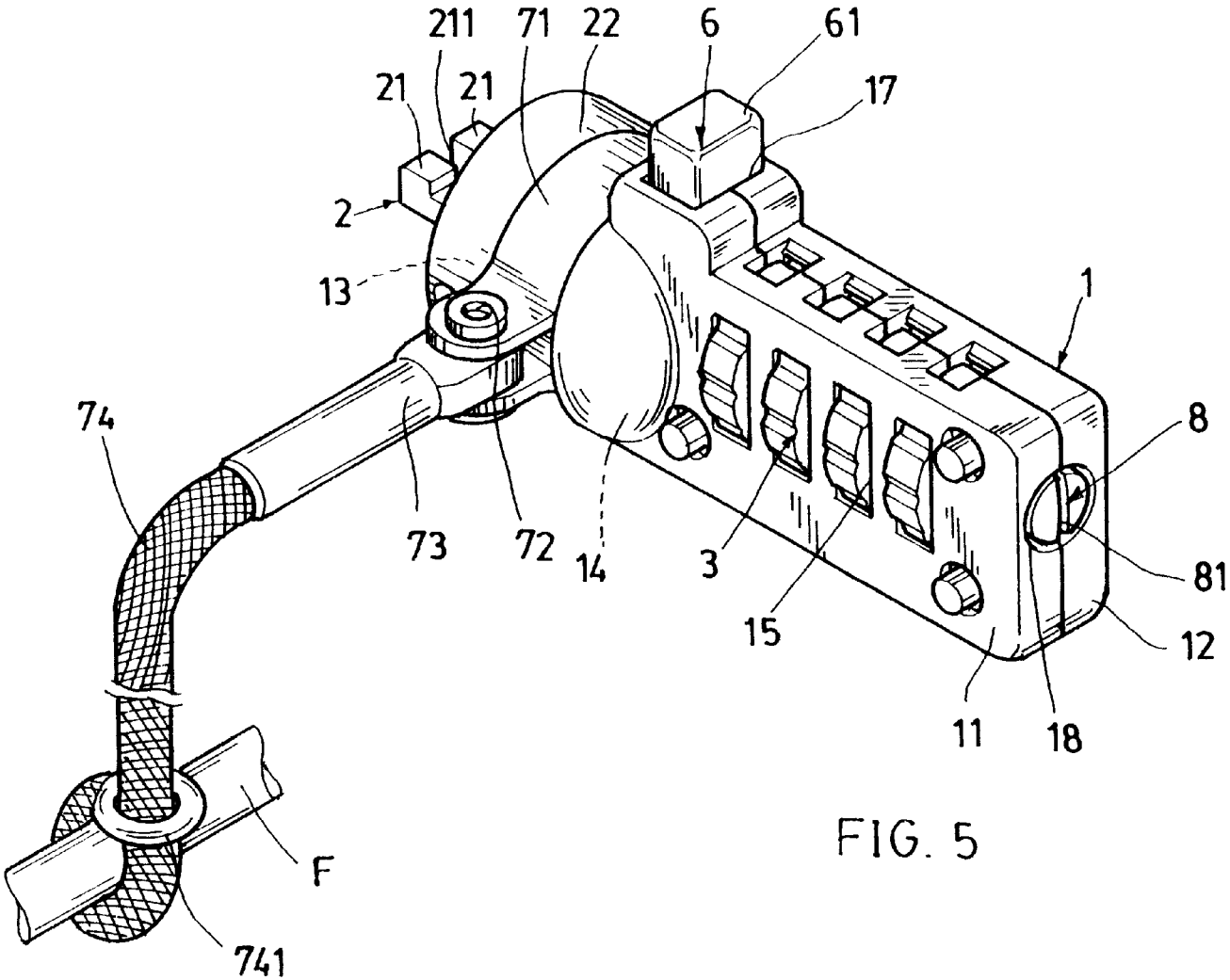
FIG. 5 is a perspective view of the present invention when assembled.

The fastening means 7 includes: a collar 71 fastening the latch holder 22 on a retainer 73 by rivet 72, and a cable 74 secured with the retainer 73 having a knot or cable head portion 741 of the cable 74 fastened to a fixture F as shown in FIG. 5.

The combination-changing means 8 includes: a driving wheel 81 having a sloping cam surface 811 formed on an inner portion of the driving wheel 81 and rotatably held in a cylindrical hole 18 formed in an end portion of the casing 1; and a follower block 82 having a groove 820 longitudinally formed therein to be slidably engageable with an extension key formed on an inside wall of the cylindrical hole 18 for slidably guiding the follower block 82 within the cylindrical hole 18 and having a follower sloping surface 821 formed on an outer portion of the follower block 82; whereby upon rotation (R) of the driving wheel 81, the sloping cam surface 811 on the driving wheel 81 will thrust the follower sloping surface 821 on the follower block 82 inwardly to push the sleeves 4 forwardly to be disengaged from the dials 3 for the free rotation of the dials for resetting a new combination when the combination is unlocked as shown in FIG. 3.

After finishing the combination changing operation, the driving wheel 81 is rotated in an opposite direction to restore the follower block 82 and the sleeves 4 as rearwardly urged by the restoring spring 54.

Figure 2:
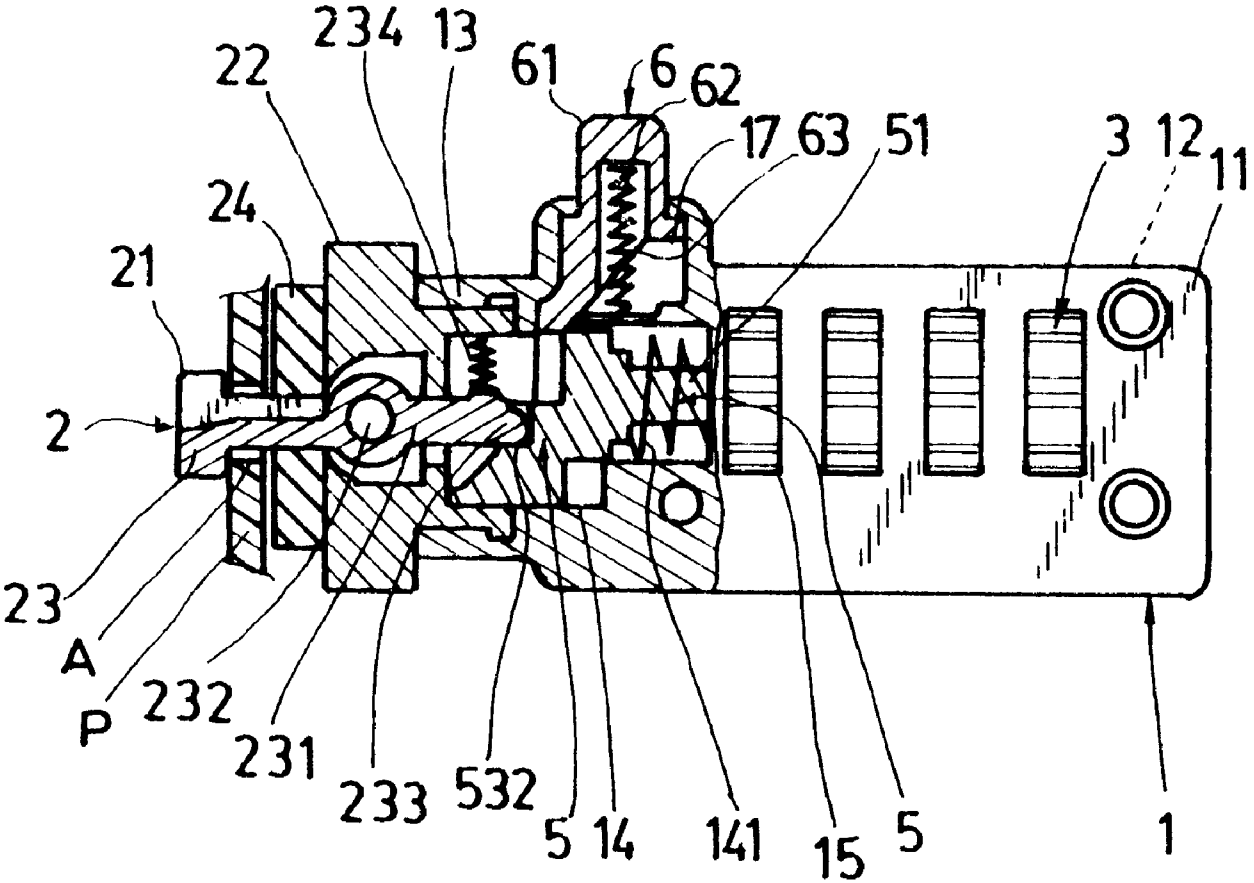
FIG. 2 is a partial sectional drawing of the present invention when locked.

When locking the combination lock of the present invention, the dials 3 are rotated to deviate the slot 44 of each sleeve 4 from the projection 52 of the bolt 51 to allow the annular extension 43 in the sleeve 4 to retard the retraction (B) of projection 52 of bolt 51; and the restoring spring 54 will urge the head portion 53 of the control means 5 forwardly to allow the wedge portion 531 to thrust the actuating end portion 233 of the pivotal latch member 23 upwardly to be seated and retarded on the retarding seat-portion 532 as shown in FIG. 2 to bias the front hook portion of the pivotal latch member 23 downwardly to allow the two latch members 21, 23 to be locked in the aperture A of the computer P.

When unlocked as shown in FIG. 4, the push button 61 is downwardly depressed (D) to retract the disk portion 533 and the wedge portion 531 to allow the spring 234 to urge the lever 231 and bias the front hook portion of the pivotal latch member 23 to be projectively coincided or matched with the front hook portion of the fixed latch member 21 to be withdrawn through the aperture A for unlocking the lock and the computer.

The present invention is superior to the conventional computer lock with the following advantages:

1. It is very convenient for unlocking the lock, just by rotating the dials 3 and without requiring a key.

2. For locking the lock, the push button 61 is depressed to insert the latch members 21, 23 into the aperture of the computer and upon releasing the depression of the push button, the latch member 23 will be resiliently restored for locking the lock on the computer or the like. So, a user's single hand can finish the locking or unlocking operation easily and conveniently.

3. The control bolt 51 is not rotatable and there is no access way from the front opening into the lock in order to intentionally retract the bolt to unlock the lock. The lock is therefore safer on the security point of view.

The present invention may be modified without departing from the spirit and scope of present invention.

What is claimed is:

1. A combination lock comprising:

a casing (1);

a pivotal latch means (2) adapted to be locked in an aperture (A) of an object to be locked including a computer (P) and the like; said pivotal latch means (2) including: a fixed latch member (21) protruding forwardly from a latch holder (22) secured to a front portion of the casing (1), and a pivotal latch member (23) pivotally mounted in the latch holder (22); with the pivotal latch member (23) having a front hook portion resiliently biased upwardly to be combinable with at least a fixed front hook portion of the fixed latch member (21) to obtain a cross sectional area of the fixed latch member (21) and the pivotal latch member (23) to be slightly less than an area of the aperture (A) of the object in order to be withdrawn through the aperture (A) when unlocking the combination lock; and upon a downward biasing of the front hook portion of the pivotal latch member (23) to allow the two front hook portions of the two latch members (21, 23) to be separately extended and locked in the aperture (A) of the object, the object will be locked; said pivotal latch member (23) including: a latch lever (231) pivotally mounted in a biasing chamber (222) formed in a cylindrical portion (221) protruding rearwardly from the latch holder (22), an actuating end portion (233) formed on an inner end of the latch lever (231) opposite to the front hook portion of the latch lever (231) and a tensioning spring (234) tensioned between the cylindrical portion (221) and the actuating end portion (233) of the latch lever (231) for normally resiliently depressing the actuating end portion (233) downwardly and for biasing the front hook portion of the latch lever (231) upwardly to coincide the front hook portion of the pivotal latch member (23) with a pair of fixed front hook portions of the fixed latch member (21) for unlocking the pivotal latch means (2) as withdrawn from the aperture (A) of the object;

a plurality of dials (3) and sleeves (4) rotatably mounted in said casing (1);

a control means (5) resiliently biasing said pivotal latch member (23) to be separately extended from said fixed latch member (21) to allow said two latch members (23, 21) to be locked in the aperture (A) of the object to be locked; and said control means operatively retracted for biasing said pivotal latch member (23) to be combinable with the fixed latch member (21) to be withdrawn from said aperture (A) of said object (P) when unlocked; and a fastening device (7) for securing said casing (1) to a fixture (F); and a combination-changing means (8) for resetting a new combination for locking the combination lock.

2. A combination lock according to claim 1, wherein said fixed latch member (21) includes said pair of fixed front hook portions juxtapositionally formed on a front portion of the latch holder (22), defining a central aperture (211) between the two fixed front hook portions of the fixed latch member (21) allowing a biasing movement of the front hook portion of the pivotal latch member (23) to be spaced within the central aperture (211) when unlocking the combination lock.

3. A combination lock according to claim 1, wherein said control means (5) includes: a control bolt (51) reciprocatively held in the casing (1), a plurality of projections (52) equally spaced and formed on the bolt (51), a control head portion (53) formed on a front end portion of the bolt (51) for retarding an unlocking of the pivotal latch member (23) when the combination lock is locked, a restoring spring (54) retained between the control head portion (53) and a washer (55) rested upon a front sleeve of the sleeves (4) mounted on the bolt (51), with the restoring spring (54) normally urging the pivotal latch member (23) to be locked on the aperture (A) in cooperation with the fixed latch member (21) for locking the combination lock; said control head portion (53) including: a wedge portion (531) formed on a front end of the control head portion (53) inclined downwardly forwardly to thrust and lift an actuating end portion (233) of the pivotal latch member (23) upwardly and to bias a front hook portion of the pivotal latch member (23) downwardly for locking the combination lock, a retarding seat portion (532) formed on an inner upper end of the wedge portion (531) for holding the actuating end portion (233) of the pivotal latch member (23) on the seat portion (532) for locking the pivotal latch member (23) for locking the combination lock, and a thrusting disk portion (533) formed on a rear end of the control head portion (53) and urged by the restoring spring (54) to be normally contacted with a push button means (6); whereby upon a downward depression of the push button means (6), the thrusting disk portion (533) will be thrusted rearwardly, without retarding the actuating end portion (233) of the pivotal latch member (23), for unlocking the pivotal latch member (23) for unlocking the combination lock.

4. A combination lock according to claim 3 wherein said thrusting disk portion (533) of the control head portion (53) of the control means (5) is formed as a square shape of a cross section of the disk portion (533) slidably engageable with a square sectioned chamber (141) formed in the casing (1), thereby preventing a rotation of the bolt (51), and ensuring a linear reciprocative motion of the bolt (51) in the casing (1).

5. A combination lock according to claim 3 wherein said push button means (6) includes: a push button (61) slidably held in a button hole (17) formed in the casing (1), a restoring spring (62) retained in the casing and urging the push button (61) upwardly ready for a depression when unlocking the lock, and a sloping surface (63) formed on a lower portion of the push button (61) and inclined downwardly forwardly for depressing and driving the thrusting disk portion (533) of the control head portion (53) rearwardly in order to allow a tensioning spring (234) to urge the actuating end portion (233) of the pivotal latch member (23) downwardly to bias the front hook portion of the pivotal latch member (23) upwardly to unlock the latch means (2) from the aperture (A) of the object.

6. A combination lock according to claim 1, wherein said combination-changing means (8) includes: a driving wheel (81) having a sloping cam surface (811) formed on an inner portion of the driving wheel (81) and rotatably held in a cylindrical hole (18) formed in an end portion of the casing (1); and a follower block (82) slidably held within the cylindrical hole (18) having a follower sloping surface (821) formed on an outer portion of the follower block (82); whereby upon rotation of the driving wheel (81), the sloping cam surface (811) on the driving wheel (81) will thrust the follower sloping surface (821) on the follower block (82) inwardly to push the sleeves (4) forwardly to be disengaged from the dials (3) for the free rotation of the dials (3) for resetting a new combination when the combination is unlocked.

* * * * *